US011391069B2

(12) United States Patent
Lai et al.

(10) Patent No.: US 11,391,069 B2
(45) Date of Patent: Jul. 19, 2022

(54) SECURITY STRAP DEVICE AND TOOL

(71) Applicant: Logistics and Supply Chain MultiTech R&D Centre Limited, Pok Fu Lam (HK)

(72) Inventors: Chun Wai Lai, Pok Fu Lam (HK); Kwong Man Pun, Pok Fu Lam (HK); Yiu Man Chan, Pok Fu Lam (HK)

(73) Assignee: Logistics and Supply Chain MultiTech R&D Centre Limited, Pok Fu Lam (HK)

( * ) Notice: Subject to any disclaimer, the term of this patent is extended or adjusted under 35 U.S.C. 154(b) by 216 days.

(21) Appl. No.: 16/791,092

(22) Filed: Feb. 14, 2020

(65) Prior Publication Data

US 2021/0254372 A1 Aug. 19, 2021

(51) Int. Cl.
*E05B 73/00* (2006.01)
*E05B 75/00* (2006.01)

(52) U.S. Cl.
CPC ..... *E05B 73/0005* (2013.01); *E05B 73/0023* (2013.01); *E05B 73/0064* (2013.01); *E05B 75/00* (2013.01)

(58) Field of Classification Search
CPC ..... E05B 67/003; E05B 73/0005; E05B 73/0023; E05B 73/0064; E05B 73/007; E05B 73/0082; E05B 73/02; E05B 75/00
See application file for complete search history.

(56) References Cited

U.S. PATENT DOCUMENTS

| | | | | |
|---|---|---|---|---|
| 4,008,512 | A * | 2/1977 | Prodel | F16L 3/2334 24/16 PB |
| 5,031,756 | A * | 7/1991 | Buzzard | E05B 73/0023 206/308.2 |
| 5,729,871 | A * | 3/1998 | Schulte | B65D 63/16 24/16 R |
| 6,510,717 | B1 * | 1/2003 | Levi | E05B 67/003 70/14 |
| 6,684,667 | B2 * | 2/2004 | Young | E05B 65/5284 70/18 |
| 8,234,757 | B2 * | 8/2012 | Lesley | E05B 67/003 24/68 CD |
| 9,555,943 | B2 * | 1/2017 | Breen, IV | A44B 11/06 |
| 9,663,975 | B2 * | 5/2017 | Castro | E05B 67/003 |
| 10,428,558 | B2 * | 10/2019 | Hall | E05B 67/003 |
| 2019/0040884 | A1 * | 2/2019 | He | E05B 67/003 |
| 2020/0232258 | A1 * | 7/2020 | Parsons | E05B 75/00 |

* cited by examiner

*Primary Examiner* — Christopher J Boswell
(74) *Attorney, Agent, or Firm* — Renner, Kenner, Greive, Bobak, Taylor & Weber

(57) ABSTRACT

A system and a method for a security strap device including a strap; a lock, the lock comprising a locking mechanism; a fixed portion of the strap being secured inside the lock; a free end of the strap insertable into the lock to form a loop in the strap, the lock is configured to lock a portion of the strap to form the loop in the strap, wherein; the locking mechanism comprises a plurality of latches moveable between a locking position and an unlocking position; the plurality of latches engaging one or more locking slots within the lock when in the locking position to the lock the strap within the lock; and wherein the latches are all simultaneously biased toward the locked position and the latches are required to be simultaneously displaced to an unlocking position to unlock the strap.

26 Claims, 10 Drawing Sheets

SECURITY STRAP DEVICE AND TOOL

TECHNICAL FIELD

The present disclosure relates to a security strap device, in particular but not limited to, a security strap device is wrapped and locked around a person's wrist or leg. The present disclosure also relates to a tool for unlocking the security strap device.

BACKGROUND

Security strap devices are commonly used in various products and in various security applications. Some examples of security strap device applications are for securing and tagging an object to a person or thing. For example, containers, luggage, monitoring units can be tagged to a person by using security strap devices. The purposes of such security strap devices are to lock an object to a person or thing such that the object is not removable. One example is to lock (i.e. tag) a monitoring unit to criminal's arms or ankles using a security strap device to monitor and track criminals on home detention or house arrest. Such security strap devices are required to be locked securely and safe from tampering or unlocking attempts. Several commonly used security strap devices can on some occasions be susceptible to picking the locks or tampering in order to remove the strap or compromise the strap.

SUMMARY OF THE INVENTION

The present disclosure relates to a security strap device, in particular but not limited to, a security strap device is wrapped and locked around a person's wrist or leg. The present disclosure also relates to a tool for unlocking the security strap device.

The security strap device disclosed herein is used for securing and tagging an object to a person or a thing. In one example the security strap device is used to lock a monitoring unit to a person in order to monitor movements of the person. The security strap device disclosed herein comprises a strap and a lock. The strap threaded through the lock and wrapped about a person or thing, and the strap is locked by the lock. The lock is advantageous because it securely locks the strap and is not easily unlocked. The tools described herein are unlocking pliers that are specifically configured to unlock the secure lock.

According to a first aspect the present disclosure relates to a security strap device comprising:

a strap;

a lock, the lock comprising a locking mechanism;

a fixed portion of the strap being secured inside the lock;

a free end of the strap insertable into the lock to form a loop in the strap, the lock is configured to lock a portion of the strap to form the loop in the strap, wherein;

the locking mechanism comprises a plurality of latches moveable between a locking position and an unlocking position;

the plurality of latches engaging one or more locking slots within the lock when in the locking position to the lock the strap within the lock; and wherein the latches are all simultaneously biased toward the locked position and the latches are required to be simultaneously displaced to an unlocking position to unlock the strap.

In one configuration the locking mechanism comprises a plurality of biasing members positioned within the lock, the plurality of biasing members associated with the plurality of latches and wherein the biasing members bias the latches toward the locking position.

In one configuration the locking mechanism comprises four latches and two biasing members, each biasing member associated with two latches and each biasing member biasing two latches simultaneously to a locking position.

In one configuration the lock comprises a first clamping member and a second clamping member, the first clamping member is attached to the second clamping member by a hinge that allows the first clamping member to pivot between a closed position and an open position relative to the second clamping member.

In one configuration in the closed position the first clamping member is located adjacent the second clamping member, the first clamping member and second clamping member clamping a portion of the strap, and the first clamping member being spaced away from the second clamping member when in the unlocked position such that the strap is freely moveable within the lock.

In one configuration the second clamping member comprising the one or more locking slots, wherein the plurality of latches engaging the one or more locking slots when the first clamping member is moved to a closed position and the strap being locked due to the first clamping member and second clamping member clamping the portion of the strap inserted into the lock.

In one configuration the second clamping member comprises:

a base, a first wall and a second wall, the first and second walls upstanding from the base, the walls being spaced apart from each other and parallel to each other, the base and the upstanding walls define a receptacle a portion of the strap being fixed within the receptacle, a first locking slot formed in the first wall and a second locking slot formed within in the second wall and wherein the first locking slot and second locking slot are parallel to each other.

In one configuration each locking slot formed on an inner surface of the respective side wall of the second clamping member.

In one configuration the strap comprises:

a plurality of fixing teeth comprising a plurality of upper teeth located at and/or adjacent the fixed portion of the strap;

a plurality of locking teeth comprising a plurality of upper teeth and lower teeth at and/or adjacent the free end of the strap;

wherein the fixing teeth are spaced away from the locking teeth along the length of the strap.

In one configuration the first clamping member comprising a plurality of locking teeth extending from a base plate of the first clamping member, wherein the locking teeth from the base plate engaging the upper teeth of the plurality of locking teeth of the strap when the first clamping member is in the closed position.

In one configuration the fixed portion of the strap comprises a pair of attachment protrusions extending from a lower face of the fixed portion of the strap, the second clamping member comprising a pair of channels or apertures within the second clamping member, the fixed portion of the strap affixed in the second clamping member by fixing the pair of protrusions within the pair of channels or apertures.

In one configuration the lower teeth of the locking teeth engage the upper teeth of the fixing teeth when the free end of the strap is inserted into the lock to form a loop in the strap.

In one configuration at least six upper teeth of the fixing teeth engage with at least six lower teeth of the locking teeth to lock the strap and form a loop in the strap.

In one configuration the first clamping member comprises at least six teeth that engage at least six upper teeth of the locking teeth when the first clamping member is positioned in the closed position.

In one configuration each latch comprises a body, a locking tab extending from the body, a pair of legs extending from the body in an opposing direction to the locking tab, and wherein the pair of legs are spaced from each other and define a passage.

In one configuration the biasing member is positioned within the passage such that the biasing member can act on the body to bias each latch to a locking position.

In one configuration the lock comprises four latches, two biasing members, each of the latches and biasing members located within the first clamping member, two latches extending out from a side wall of the first clamping member and two other latches extending from an opposing side wall of the first clamping member.

In one configuration the four latches are arranged in pairs, each pair of latches is arranged such that the latches extend to a locked position in opposing directions, and each biasing member is positioned to act on each pair of latches and bias them away from each other.

In one configuration the second clamping member comprises a plurality of pin holes, each pin hole is aligned with the locking slot.

In one configuration the each of the pin holes aligns with a latch such that an unlocking tool can be used to push the latches via the pin holes to an unlocked position to unlock the lock.

In one configuration the unlocking tool comprises:

a first arm and a second arm, a handle defined at one end of each arm, an unlocking feature located at or adjacent an end of the arm opposite to the handle, a pivot coupling the first arm to the second arm, the handles being moved in apart from each other causing the first and second arm to move about the pivot, thereby causing the unlocking feature at the end of each arm to push the latches simultaneously from a locked position to an unlocked position.

In one configuration each arm comprises two unlocking features located at the end opposite to the handle.

In one configuration the unlocking feature is a pin, each arm comprises two pins that are spaced from each other, the pins are spaced apart to align with the latches when the unlocking tool is positioned on the lock.

In one configuration the unlocking tool comprises a lower housing, the lower housing including a plurality of unlocking features and in use, the handles moving away from each other cause the end of the first arm and the end of the second arm to move toward each other and push the unlocking features toward each other.

In one configuration the lower housing is a U shaped housing, the housing comprises a pair of free ends, the housing accommodating two pins at each free end, a first arm positioned inside one free end of the housing and the second arm position in the opposing end of the housing, the arms moveable within the housing to push on a cam surface of the pins to simultaneously push the pins toward each other.

In one configuration, in use, the handles are moved away from each other causing the ends of the arms inside the housing to move in toward each other to simultaneously push the pins toward each other out of the housing, the pins being pushed out of the housing cause the latches to be pushed to an unlocked position.

According to a second aspect, the present disclosure relates to a security device and an unlocking tool comprising:

a security device comprising:

a strap;

a lock, the lock comprising a locking mechanism;

a fixed portion of the strap being secured inside the lock;

a free end of the strap insertable into the lock to form a loop in the strap, the lock is configured to lock a portion of the strap to form the loop in the strap, wherein;

the locking mechanism comprises a plurality of latches moveable between a locking position and an unlocking position;

the plurality of latches engaging one or more locking slots within the lock when in the locking position to the lock the strap within the lock; and wherein the latches are all simultaneously biased toward the locked position and the latches are required to be simultaneously displaced to an unlocking position to unlock the strap, the unlocking tool comprising:

a first arm and a second arm, a handle defined at one end of each arm, a plurality of unlocking pins located at or adjacent an end of the arm opposite to the handle, a pivot coupling the first arm to the second arm such that the first arm can pivot relative to the second arm when the handles are moved, in use, the unlock tool being positioned such that one unlocking pin aligns with each latch, and;

the handles being moved in a first direction to pivot the first arm relative to the second arm, thereby causing each unlocking pin to push the latches simultaneously from a locked position to an unlocked position thereby unlocking the lock to allow the strap to move.

Features from one or more embodiments or configurations described herein may be combined with features of one or more other embodiments or configurations. Additionally, more than one described embodiment or configuration or form may be used together during a process of respiratory support of a patient.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

It should be understood that alternative embodiments or configurations may comprise any or all combinations of two or more of the parts, elements or features illustrated, described or referred to in this specification.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

As used herein the term 'and/or' means 'and' or 'or', or where the context allows both.

In the following description like numbers denote like features.

As used herein "(s)" following a noun means the plural and/or singular forms of the noun.

In this specification, the word "comprising" and its variations, such as "comprises", has its usual meaning in accordance with International patent practice. That is, the word does not preclude additional or unrecited elements, substances or method steps, in addition to those specifically recited. Thus, the described apparatus, substance or method may have other elements, substances or steps in various embodiments. The term "comprising" (and its grammatical variations) as used herein are used in the inclusive sense of "having" or "including" and not in the sense of "consisting only of".

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

BRIEF DESCRIPTION OF THE DRAWINGS

Notwithstanding any other forms which may fall within the scope of the present disclosure, one or more embodiments of a seat apparatus will now be described, by way of example only, with reference to the accompanying drawings in which.

DETAILED DESCRIPTION OF THE PREFERRED EMBODIMENTS

The present disclosure relates to a security strap device, in particular but not limited to, a security strap device is wrapped and locked around a person's wrist or leg. The present disclosure also relates to a tool for unlocking the security strap device.

The security strap device is configured to lock the strap about a persons limb e.g. wrist or leg by creating a loop of the strap. The security strap device provides a locking system that comprises a plurality of latches that are all simultaneously biased toward the locked position. The latches being simultaneously biased to a locked position makes the security strap device difficult to remove. The security strap device is also advantageous because it is substantially tamper proof because the latches are covered within a clamping member and the latches are all simultaneously biased to a locked position.

A specifically designed unlocking tool is required for use with the security strap device. The unlocking tool is designed to have unlocking features that simultaneously unlock the latches i.e. simultaneously move the latches from a locked position to the unlocked position to allow unlocking and removal of the security strap device. The unlocking tool can be provided to authorised personnel e.g. parole officers, police officers, or other law enforcement officers.

Figure 1:
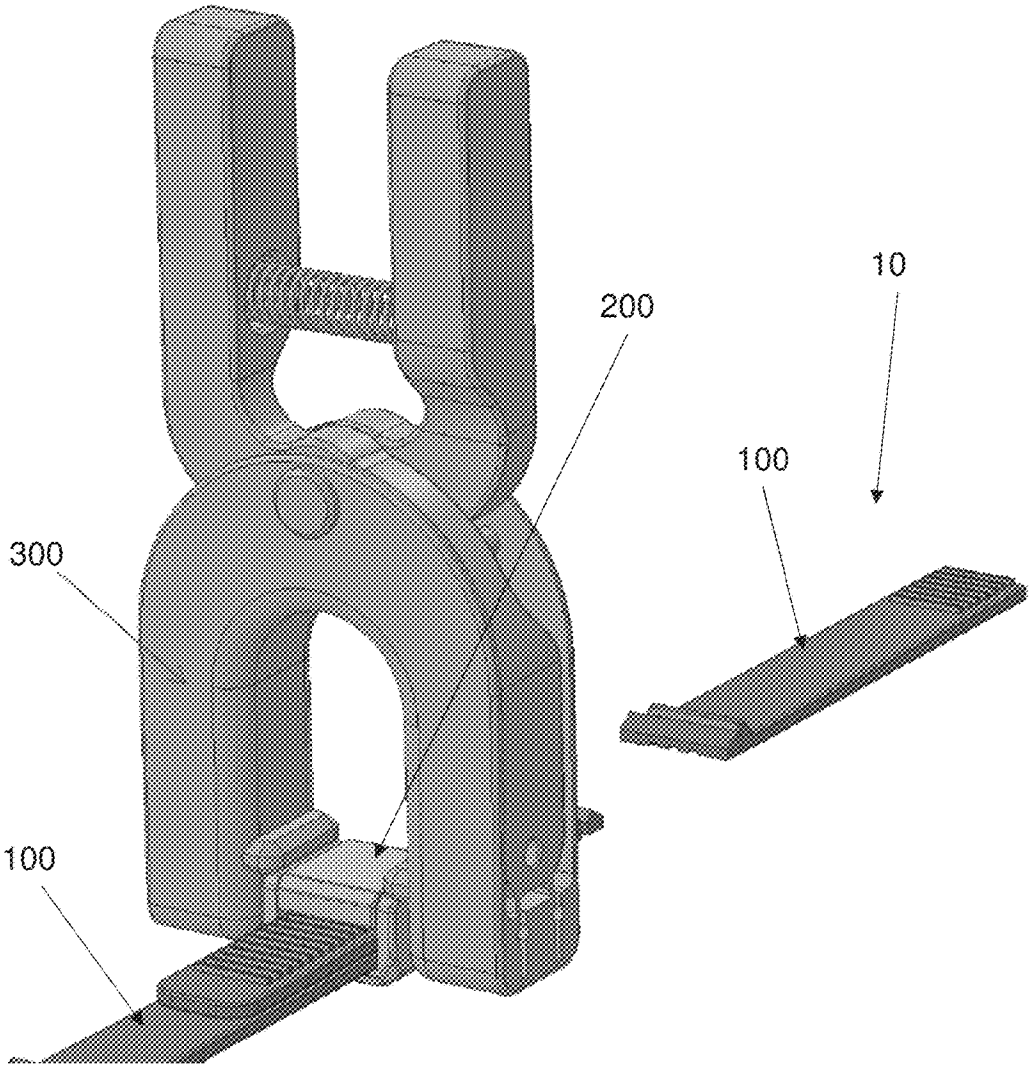
FIG. 1 shows an example of a security strap device and an unlocking tool.

FIG. 1 shows an example embodiment of the security strap device 10 and an unlocking tool 300. The security strap device 10 includes a lock 200. The unlocking tool 300 is positioned around the lock and used to unlock the lock 200.

Figure 2:
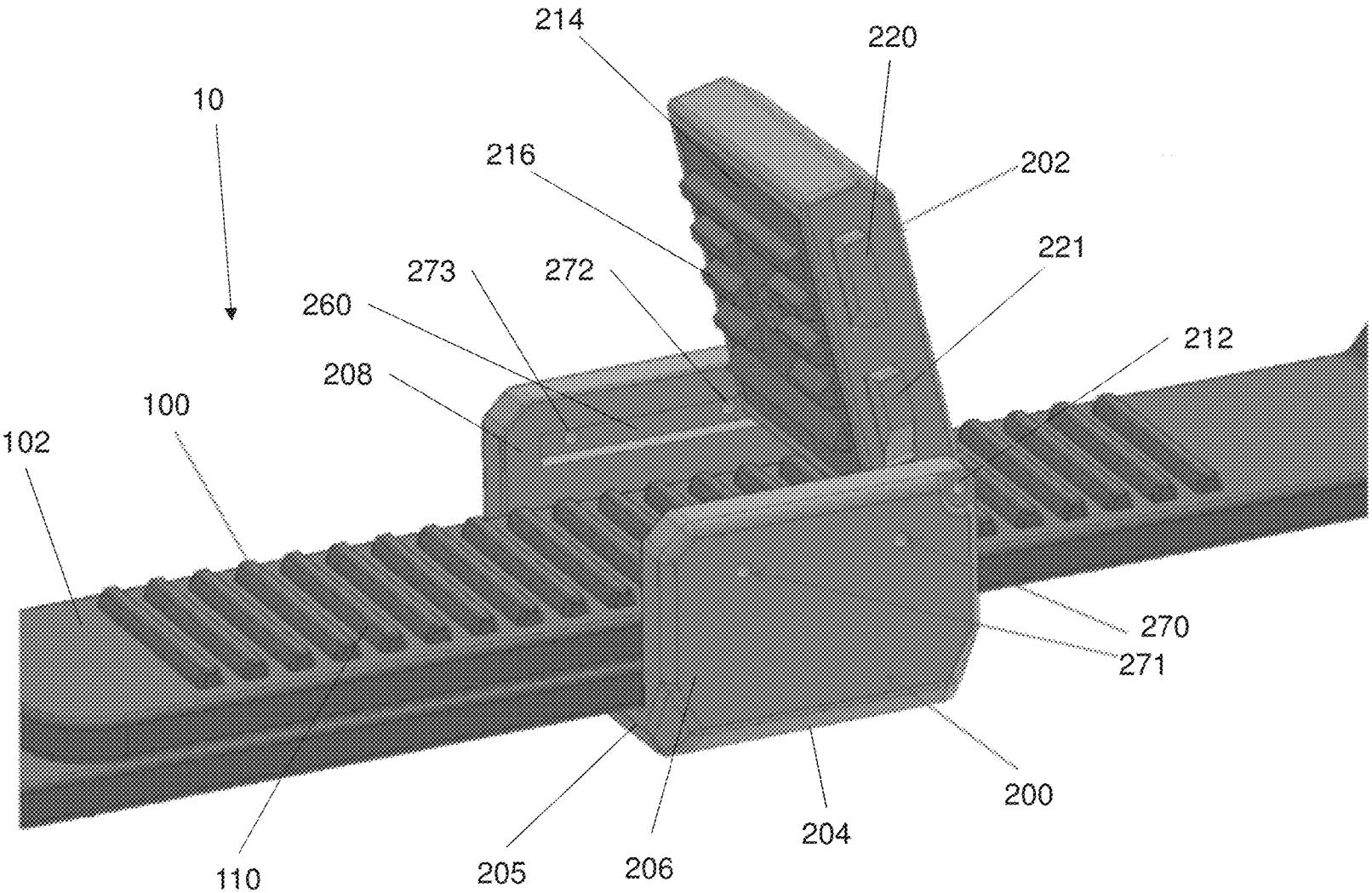
FIG. 2 and FIG. 3 illustrate the security strap device and the lock.
Figure 3:
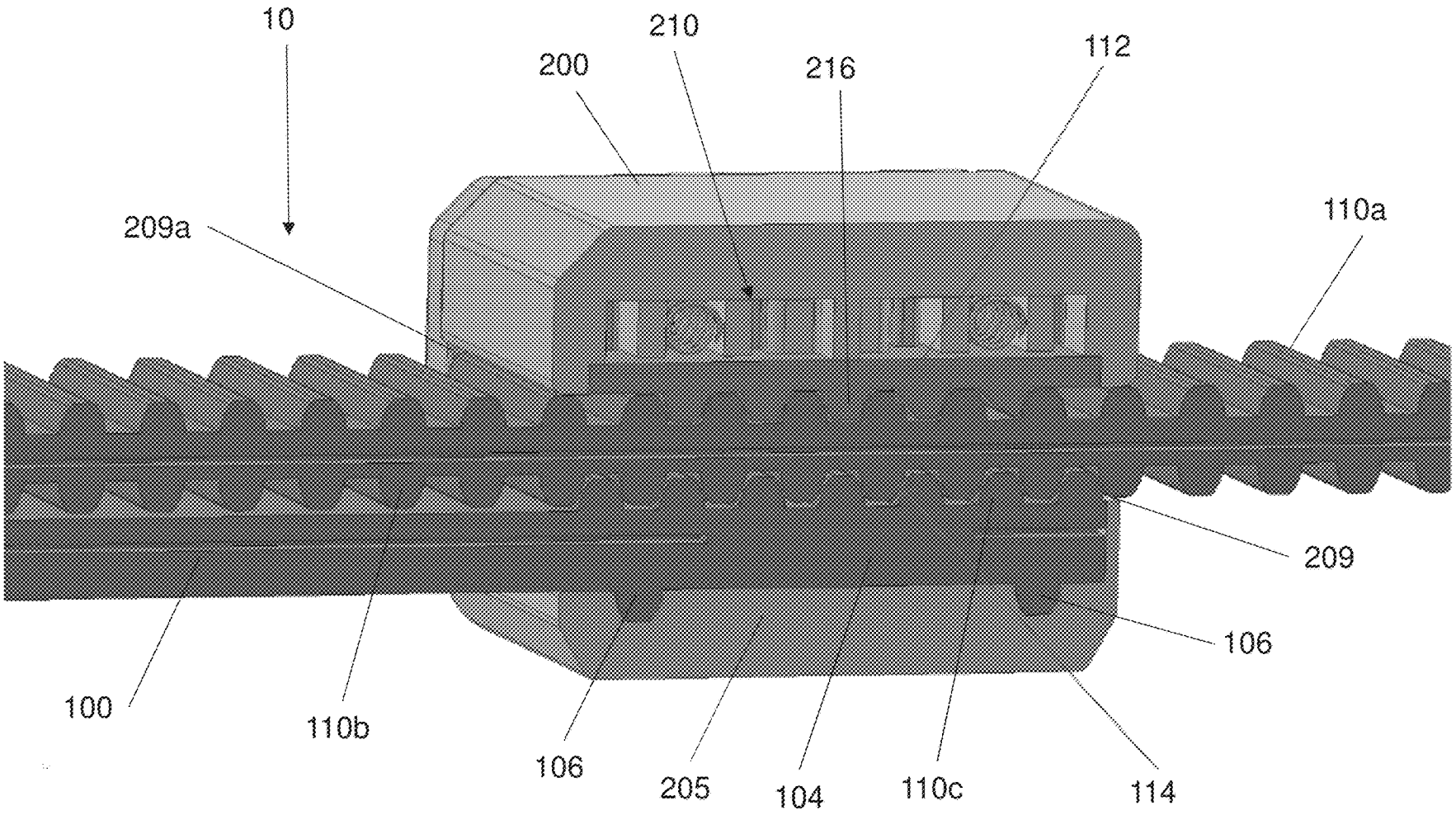

FIGS. 2 and 3 show an example embodiment of the security strap device 10. The security strap device 10 comprises a strap 100, a lock 200, the lock comprises a locking mechanism 210. The strap 100 comprises a fixed portion of the strap 104 that is secured inside the lock 200. A free end 102 of the strap is insertable into the lock 200 to form a loop in the strap 100. The lock 200 is configured to lock a portion of the strap 100 to form the loop in the strap around a limb of a person.

The locking mechanism 210 comprises a plurality of latches moveable between a locking position and an unlocking position. The plurality of latches engaging one or more locking slots within the lock 200 when in the locking position to the lock the strap 100 within the lock 200. The latches are all simultaneously biased toward the locked position and the latches are required to be simultaneously displaced to an unlocking position to unlock the strap 100.

Referring to FIGS. 2 and 3, the strap 100 comprises a free end 102 and a fixed portion 104. The fixed portion 104 is fixed inside the lock 200. The free end 102 is looped around a person's limb and then inserted through the lock, as shown in FIG. 2 and FIG. 3. The free end 102 is inserted and laid on top of the fixed portion to create a loop in the strap 100.

The strap 100 comprises a plurality of teeth 110 extending outwardly from the strap. The strap comprises a plurality upper teeth 110*a* extending from an upper surface of the strap and a plurality of lower teeth 110*b* extending from a lower surface of the strap. The upper teeth 110*a* extend in an opposing direction the lower teeth 110*b*.

The strap further comprises a plurality of fixing teeth 110*c* located at the fixed portion 104 of the strap. The fixing teeth 110*c* extend upwardly from a surface of the fixed portion of the strap 104. The strap comprises a plurality of locking teeth 112, 114 that are formed at and/or adjacent the free end. A region of the strap adjacent the free end comprises a plurality of upper teeth and lower teeth that define the locking teeth 112, 114. The fixing teeth 110*c* are spaced away from the locking teeth 112, 114 along the strap.

The fixed portion 104 of the strap comprises a pair of attachment protrusions 106 that extend from a lower face of the fixed portion of the strap. The attachment protrusions 106 engage the lock to fix the strap in the lock 200.

The lock 200 comprises a first clamping member 202 and a second clamping member 204. The first clamping member 202 is pivotable relative to the second clamping member 204. The first clamping member 202 is attached to the second clamping member 204 by a hinge 212. The hinge allows the first clamping member 202 to pivot from a locked position as shown in FIG. 3 to an unlocked position as shown in FIG. 2. In the unlocked position the first clamping member 202 is spaced away from the second clamping member 204.

In use, the free end of the strap 102 is threaded through an opening 209 in the lock 200. The opening is defined by the space at the hinge 212 between the first clamping member 202 and the second clamping member 204. The lock 200 also comprises an opening at the opposing end 209*a*. The openings 209, 209*a* are aligned. The free end of the strap 102 is passed through both openings to create a loop in the strap.

The second clamping member 204 comprises a base 205 and two upstanding walls 206, 208. The upstanding walls 206, 208 extend upwardly from the base 205. The base 205 and the walls 206, 208 define a receptacle to receive and fix the fixed portion 104 of the strap. Each upstanding wall 206, 208 each comprise a locking slot 260, 262. A first locking slot 260 is formed within the wall 206 and a second locking slot 262 is formed in the wall 208. In the example embodiment each upstanding wall 206, 208 comprise a single locking slot 260, 262 formed in the wall. The locking slots 260, 262 are a horizontal slot formed in the upstanding wall. The slots 260, 262 may be identical to each other in shape and dimensions.

As shown in FIG. 3, the base 205 of the second clamping member 204 comprises a pair of channels that receive the attachment protrusions 106 that extend from a lower face of the fixed portion 104 of the strap 100. The attachment protrusions 106 are engaged as a friction fit or may be glued in or may be welded into the second clamping member 204. The fixed portion of the strap may be removable or may be permanently fixed to fasten the lock 200 to the strap 100.

The first clamping member 202 comprises a locking mechanism 210 disposed within the first clamping member 202. The first clamping member 202 defines a casing and comprises a base plate 214. The base plate 214 comprises a plurality of locking teeth 216 that extend outwardly from the base plate 214. The locking teeth 216 engage the upper teeth 112 of the strap. As seen from FIGS. 2 and 3 each of the clamping members 202, 204 define a hollow casing that houses different components. The second member 204 has an open top to receive the strap.

In use, the free end of the strap 102 is threaded through the lock 200 as shown in FIG. 2 and FIG. 3. As shown in FIG. 3, the lower locking teeth 114 engage the fixed teeth 110*c*. The first clamping member 202 is closed i.e. moved to a locked position to lock the strap in the lock. The locking teeth 216 of the first clamping member 202 engage the upper teeth 112 of the strap when the first clamping member is closed. The locking teeth 216 engage between the gaps between adjacent teeth on the strap.

As shown in FIG. 3 the first clamping member 202 comprises six locking teeth 216. The six locking teeth 216 engage six corresponding upper teeth 112 of the strap. Six lower teeth 114 engage six fixing teeth 110*c*. A total of 12 strap teeth i.e. six upper teeth 112 and six lower teeth 114 are engaged when the first clamping member is moved to a closed position. The friction between the twelve total engaged teeth provides a substantial locking force. The twelve teeth absorb loading on the strap e.g. pulling loads, push loads as well as torsion loads, thus securing the strap and preventing a user from being able to remove the strap. When the first clamping member is in the unlocked position i.e. spaced away from the second clamping member 204, the free end of the strap can be pulled since only six teeth i.e. the lower teeth engage the fixing teeth. The force from six teeth can be overcome by a pulling force from a user to adjust the length of the strap i.e. adjust the size of the loop of the strap to fit various limbs or various users. The current security strap device is advantageous because when the lock is locked i.e. the strap is clamped within the first and second clamping members, at least twelve teeth of the strap are engaged. Six teeth adjacent the free end are engaged on both the top and bottom i.e. both sets of teeth are engaged thereby increasing the friction between the strap teeth and the locking teeth and fixing teeth. This increased friction secures the strap and reduces the chances of the strap being pulled to loosen the strap.

The first clamping member 202 is required to be held in the locked position to secure the strap 100 in the lock 200 and prevent someone from loosening the strap. The first clamping member 202 is held in the locked position by the locking mechanism 210.

FIGS. 4 to 7 illustrate details of the locking mechanism 210. The locking mechanism 210 comprises a plurality of latches that are simultaneously biased toward a locking position. As shown in FIGS. 4 to 7, the locking mechanism 210 comprises four latches 220, 221, 222, 223. Alternatively, the locking mechanism 210 may comprise six or more latches. Preferably the locking mechanism 210 comprises an even number of latches. Preferably the locking mechanism comprises four or more latches since two latches are easier to unlock.

The latches 220-223 engage the locking slots 250 in the second clamping member 204. The latches 220-223 are disposed inside the casing formed by the first clamping member 202. Each latch is substantially similar in construction. Each latch comprises a body and a pair of legs. The legs are spaced apart from each other and define a passage. The locking mechanism 210 further comprises a plurality of biasing member configured to bias the latches to a locking position. The biasing members are arranged to simultaneously bias the latches to a locking position. Each latch comprises a locking tab that extends from the body in an opposing direction to the legs.

Figure 4:
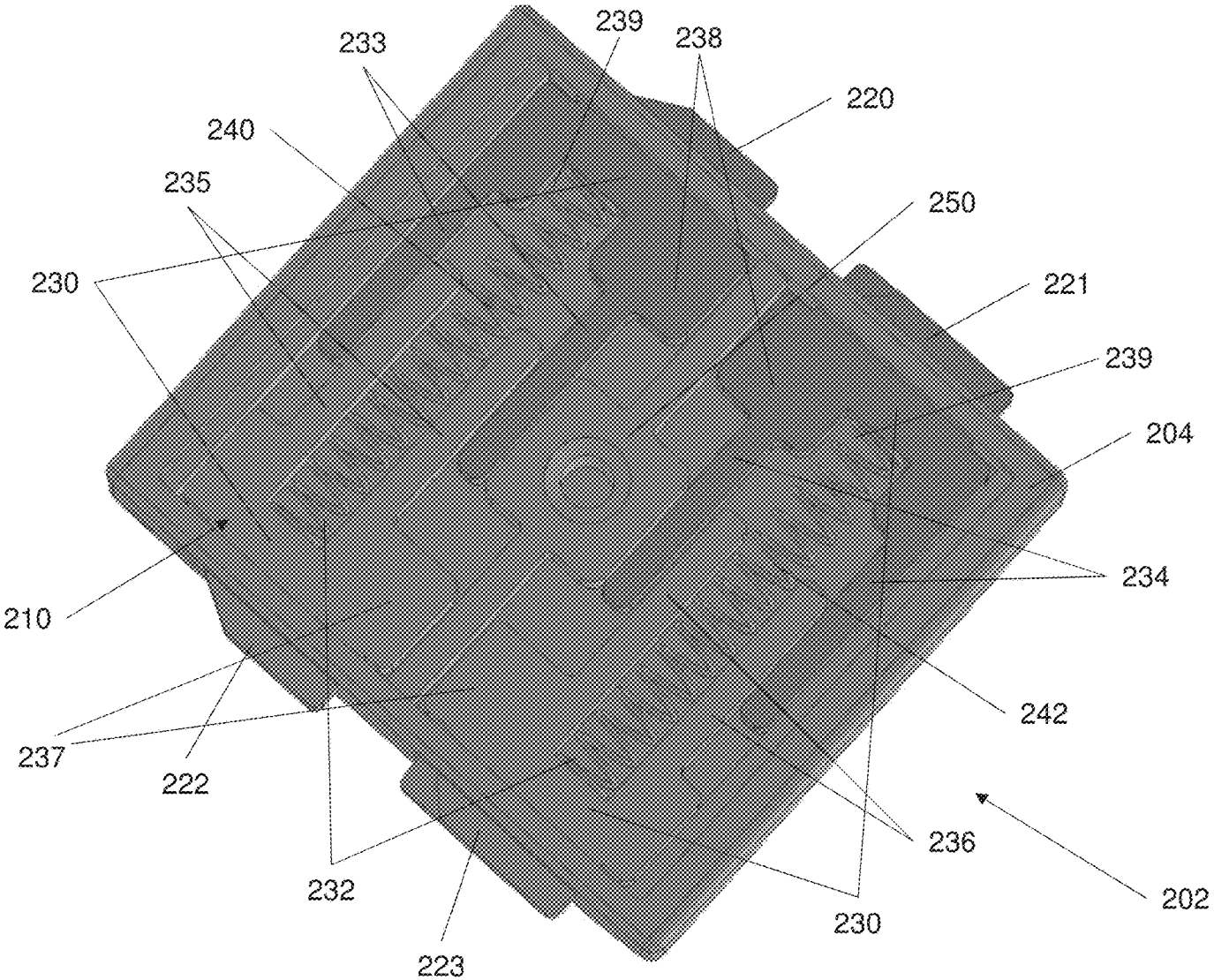
FIG. 4 illustrates an internal view of the first clamping member and the locking mechanism of the lock.

As shown in FIG. 4 each latch comprises a body 230. The first latch 220 comprises a pair of legs 233 that extend parallel to each other from the body 230. The second latch 221 comprises a pair legs 234 that extend parallel to each other from the body 230 of the latch 221. The third latch 222 comprises a pair of legs 235 that extend parallel to each other from the body 230. The fourth latch 223 comprises a pair of legs 236 that extend parallel to each other from the body 230. The legs of each latch define a passage 232 between the legs.

The latches 220-223 are arranged in pairs. The first latch 220 is positioned opposite the third latch 222 and the second latch 221 is positioned opposite the fourth latch 223. The passage 232 extends between the legs of each pair of latches. The legs 235 of the third latch are nested within the legs of 233 of the first latch 220. The legs 236 of the fourth latch 223 are nested inside the legs 234 of the second latch 221. The first latch 220 and second latch 221 are substantially identical to each other in shape. The third latch 222 and fourth latch 223 are substantially identical to each other in shape.

The first latch 220 and second latch 221 each comprise a slot 239 formed in the body. The slot is formed in an opposing direction to the extension of the legs. The slot 239 formed in the first latch and the second latch are substantially identical to each other. The slot 239 of the first latch 220 and the legs 235 of the third latch define the passage 232. The slot 239 of the second latch 221 and the legs 236 of the fourth latch 223 define the passage 232. The latches each comprises a portion that extends out of the casing of the first clamping member 202. The passage defined by the legs of the latches and the slots 239 constrain the linear motion of the biasing members 240, 242. The passages 232 and the slots 239 ensure the biasing member linearly biases the latches away from each other. The portion that extends out functions as a locking tab and is received within and engages the locking slots 260, 262 within the second clamping member 204.

Figure 5:
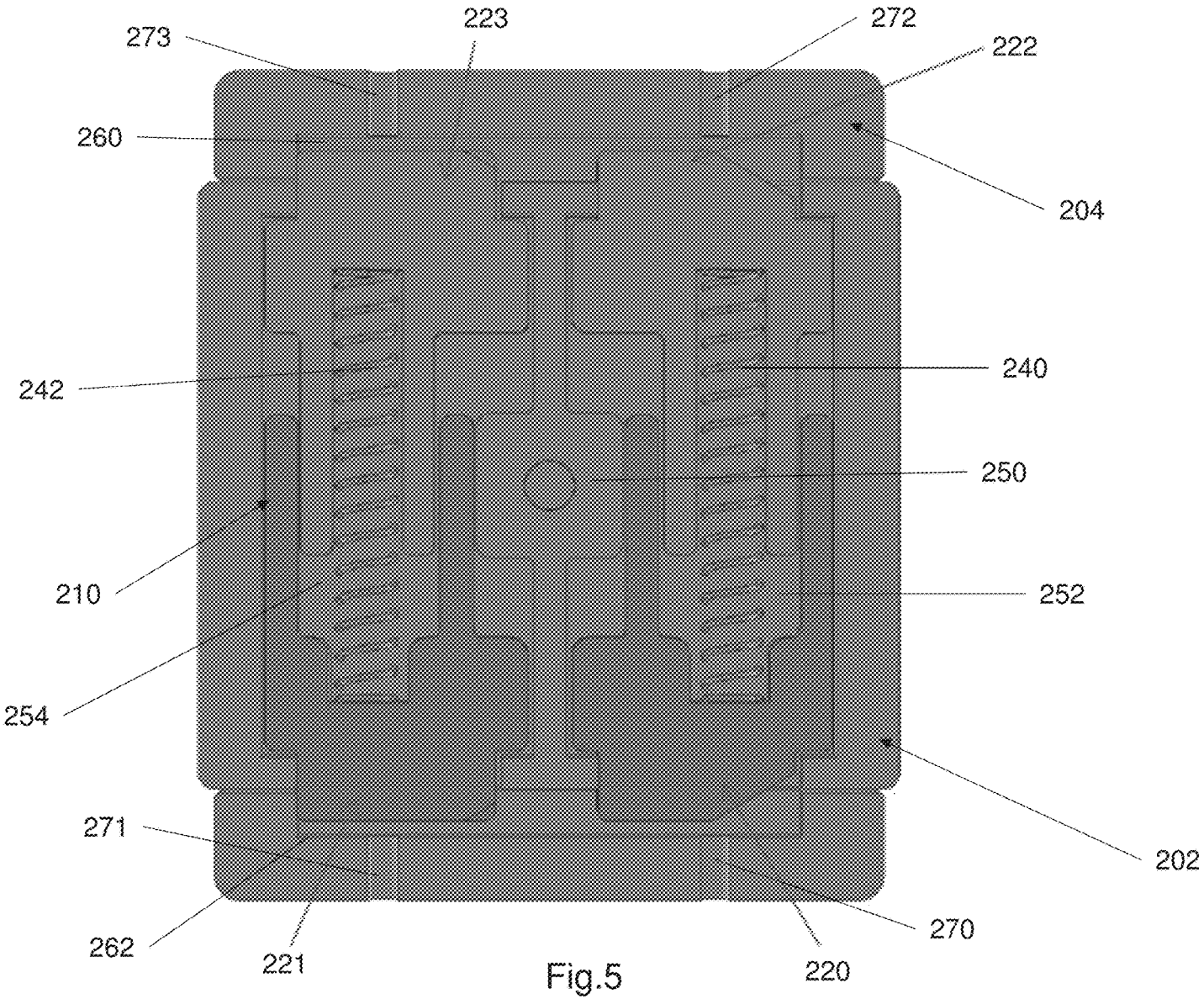
FIG. 5 to FIG. 7 illustrates the locking mechanism in use.

The latching mechanism further comprises a plurality of biasing members that simultaneously bias the latches to a locking position. As shown in the illustrated embodiment the latching mechanism 210 comprises two biasing member 240, 242. The biasing members 240, 242 are coil springs. Preferably the springs 240, 242 are compression springs i.e. they are supposed to be compressed in use, but are biased toward a rest position. The biasing member 240 is positioned between the first latch 220 and the third latch 222. The biasing member 242 is positioned between the second latch 221 and the fourth latch 223. The first biasing member 240 simultaneously biases the first latch 220 and the third latch 222 to a locking position, as shown in FIG. 4 and FIG. 5. The second biasing member 242 simultaneously biases the second latch 221 and the fourth latch 223 to a locking position as shown in FIG. 4 and FIG. 5.

The biasing members 240, 242 are identical to each other in size, shape and spring constant. The biasing members bias the latches away from each other i.e. the biasing members provide a pushing force to push the pair of latches away from each other. The first latch 220 and the third latch 222 are pushed away from each other to a locking position. The second latch 221 and the fourth latch 223 are pushed away from each other to a locking position. The biasing members 240, 242 are configured to providing a biasing force that is linear along the biasing member. The biasing members bias outward i.e. push the latches within each pair of latches away from each other. For example, the biasing member 240 biases the first latch 220 away from the third latch 222. The second biasing member biases the second latch 221 away from the fourth latch 223.

The first clamping member 202 comprises a partition wall 250 that defines a first receptacle 252 on each side of the partition 250 and a second receptacle 254 on the other side of the partition 250. Each receptacle 252, 254 is identical to each other. Each receptacle receives a pair of latches and a biasing member. As shown in FIG. 5, one receptacle 252 houses the first latch 220, third latch 222 and the first biasing member 240. The second receptacle 254 houses the second latch 221 and the fourth latch 223 and the second biasing member 242.

The first latch and third latch each comprise a flange 238 extending outwardly from the body. The second and fourth latch each comprise a flange 237 extending outwardly from the body. The flange 238 on the first and third latch 220, 222 contacts with a wall of the receptacle 252. The flange 238 constrains the motion the first and third latch in the receptacle 252. The flange 238 assists in the latches moving in a linear manner. The latch 239 of the second and fourth latch contacts a wall of the second receptacle 254 and constrains the motion of the second and fourth latches. The flange 237 of the second and fourth latches helps these latches to move in a linear manner within the receptacles. The first and third latches 220, 222, may comprise a chamfered portion in the locking tab to allow the tab to be accommodated within the second clamping member 204.

Figure 6:
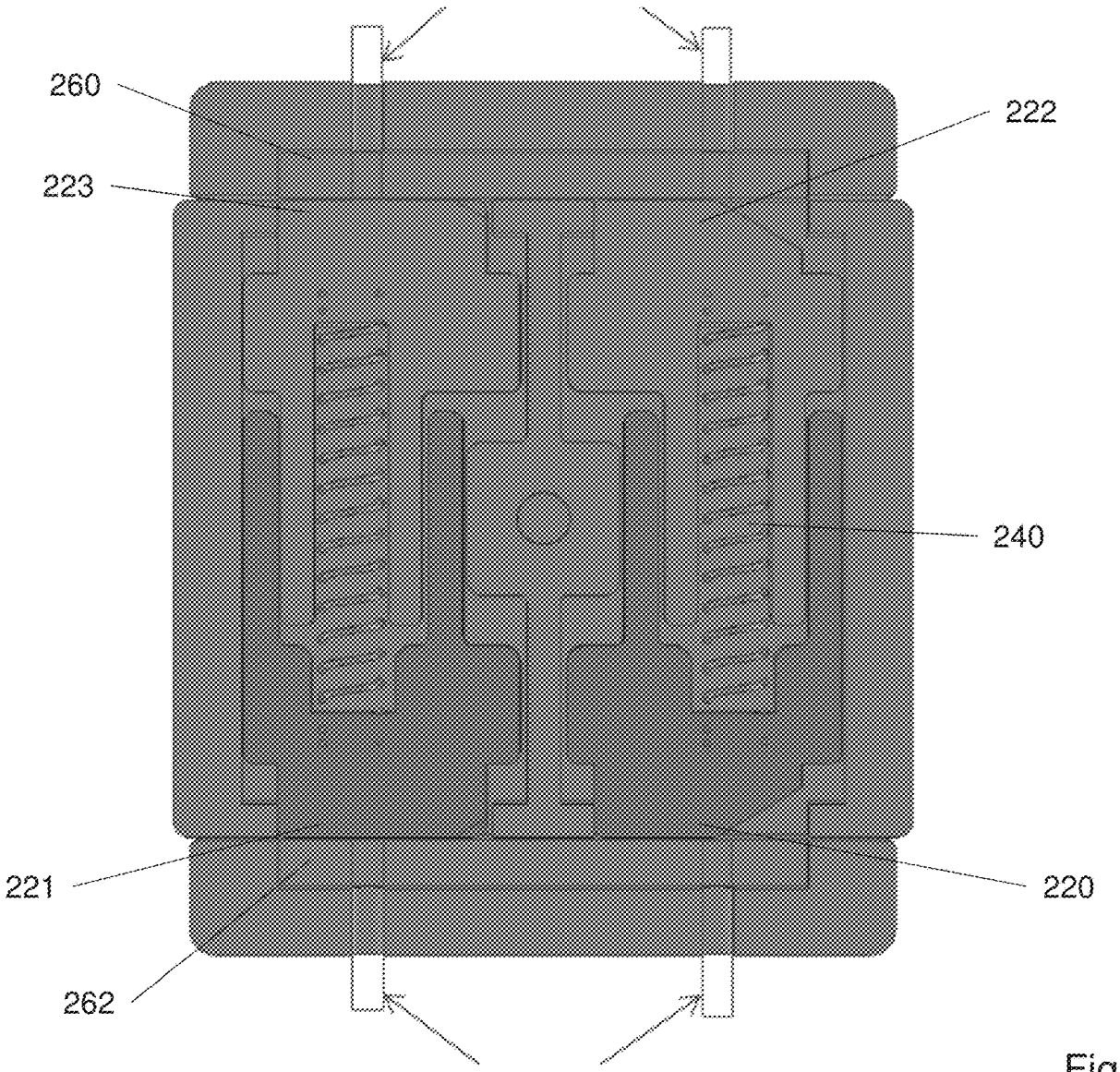
Figure 7:
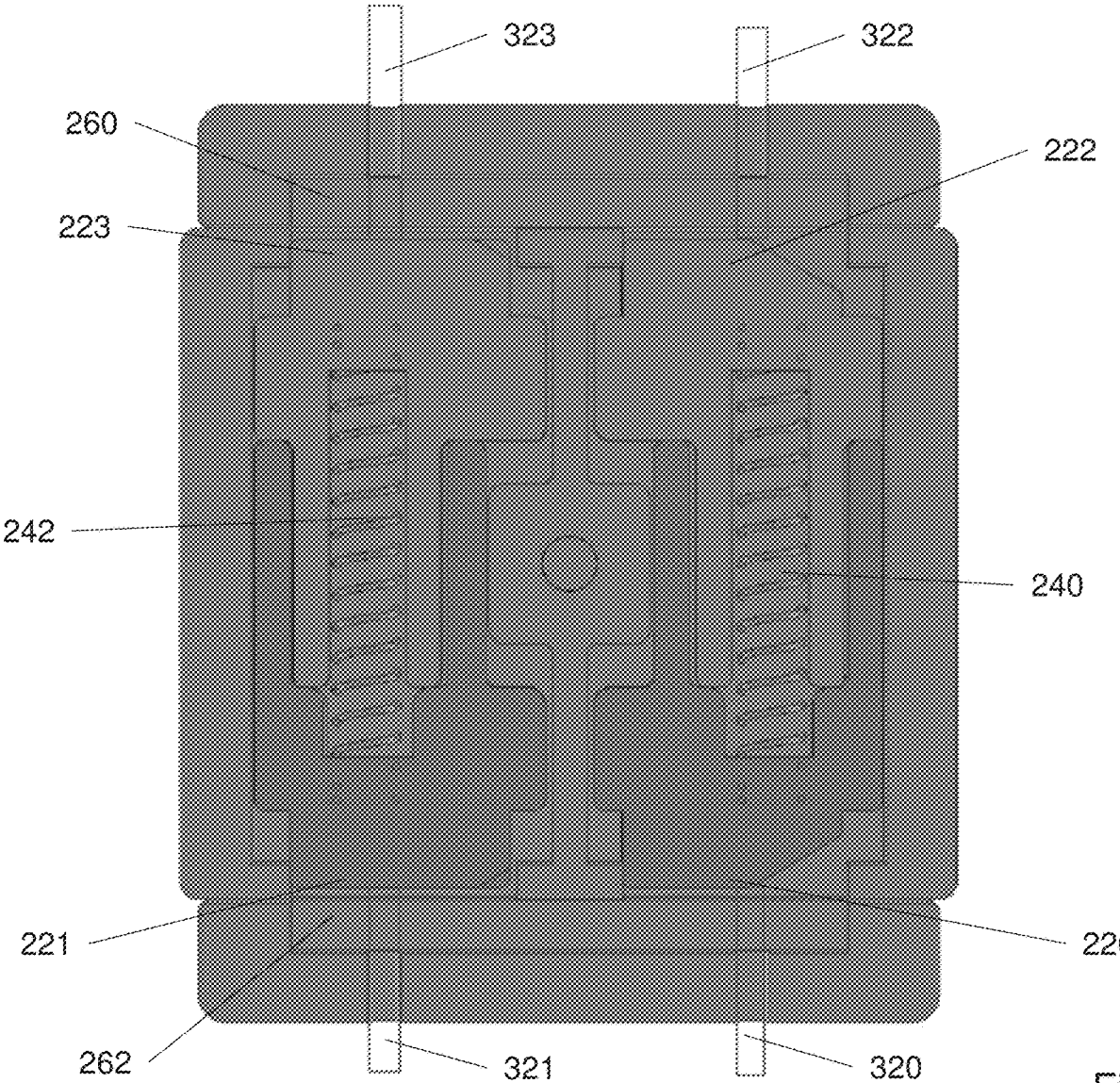

FIGS. 5 to 7 illustrate the locking mechanism in use. FIG. 5 illustrates the locking mechanism 210 with the latches 220-223 in the locking position. FIG. 6 illustrates the latches 220-223 being moved to an unlocking position. FIG. 7 shows the latches 220-223 in an unlocking position. Referring to FIG. 5, a portion of each latch 220-223 extends out of the first clamping member 202. The portion that extends functions as a locking tab. The latches 220-223 extend out and are received into the locking slots 260, 262. The locking slots 260, 262 are dimensioned to lock the first clamping member to the second clamping member by housing the latches. The slots 260, 262 are sized and dimensioned to prevent vertical, horizontal or twisting of the first clamping member 202 relative to the second clamping member 204. The latches 220-223 hit one of the walls of the locking slot if the lock is tampered with when the first clamping member 202 is in the closed position.

The latches 220-223 are simultaneously biased to the locking position i.e. biased to extend out of the first clamping member. The latches 220-223 are required to be simultaneously moved to an unlocking position. If one or two latches are moved, the other latches remain engaged in the locking slot. For example, if the first latch 220 is pushed out of the locking slot, the third latch 222 will be pushed further into its locking slot, and the second and fourth latches 221, 223 remain engaged in their respective locking slots. This simultaneous locking and simultaneous bias toward the locking position is advantageous because the lock 200 securely locks and cannot be unlocked easily.

The biasing members 240, 242 float within the first clamping member 202. Each biasing member 240, 242 acts to simultaneously bias the latches to the locking positions. The four latches 220-223 with two biasing members 240, 242 acting on each pair of latches to simultaneously bias them to a closed position makes the lock difficult and challenging to unlock. The four latches are arranged in pairs with a single spring biasing each of the latches in a pair to a closed position makes the lock difficult to unlock. This is because the latches have to all be simultaneously unlocked rather than unlocking one or two latches at a time.

The second clamping member 204 comprises four pin holes 270, 271, 272, 273. Each pin hole aligns with one of the latches 220-223. Two pin holes 270, 271 are formed in the first upstanding wall 206 and two pin holes 272, 273 are formed in the second upstanding wall 208. The pin holes 270-273 open into the locking slots 260, 262. Unlocking pins can be inserted through the pin holes 270-273 to push the latches out of the locking slot to unlock the lock.

FIG. 6 shows four 320, 321, 322, 323 (320-323) acting on the latches to simultaneously push the latches 220-223 out of the locking slots 260, 262. The latches 220-223 are pushed to an unlocking position simultaneously by the pins 320-323. The unlocking position is the position shown in FIG. 7 where the latches are fully within the first clamping member 202. The latches 220-223 being pushed toward each other i.e. out of the locking slots 260, 262 causes the biasing members 240, 242 to compress.

FIG. 7 shows the pins 320-323 acting on the latches simultaneously to unlock the latches and unlock the first clamping member 202 from the second clamping member 204. The first clamping member 202 being unlocked causes the lock 200 to be unlocked such that the first clamping member 202 can be pivoted away from the second clamping member 204. The lock 200 being unlocked i.e. the first clamping member 202 being pivoted away allows a user to withdraw the free end of the strap 102 from the lock 200 and remove the security strap device 10 from a user. As shown in FIG. 7, the latches 220-223 are pushed completely into the first clamping member 202 i.e. completely out of the locking slots 250, 252 by the pins 320-323.

Figure 8:
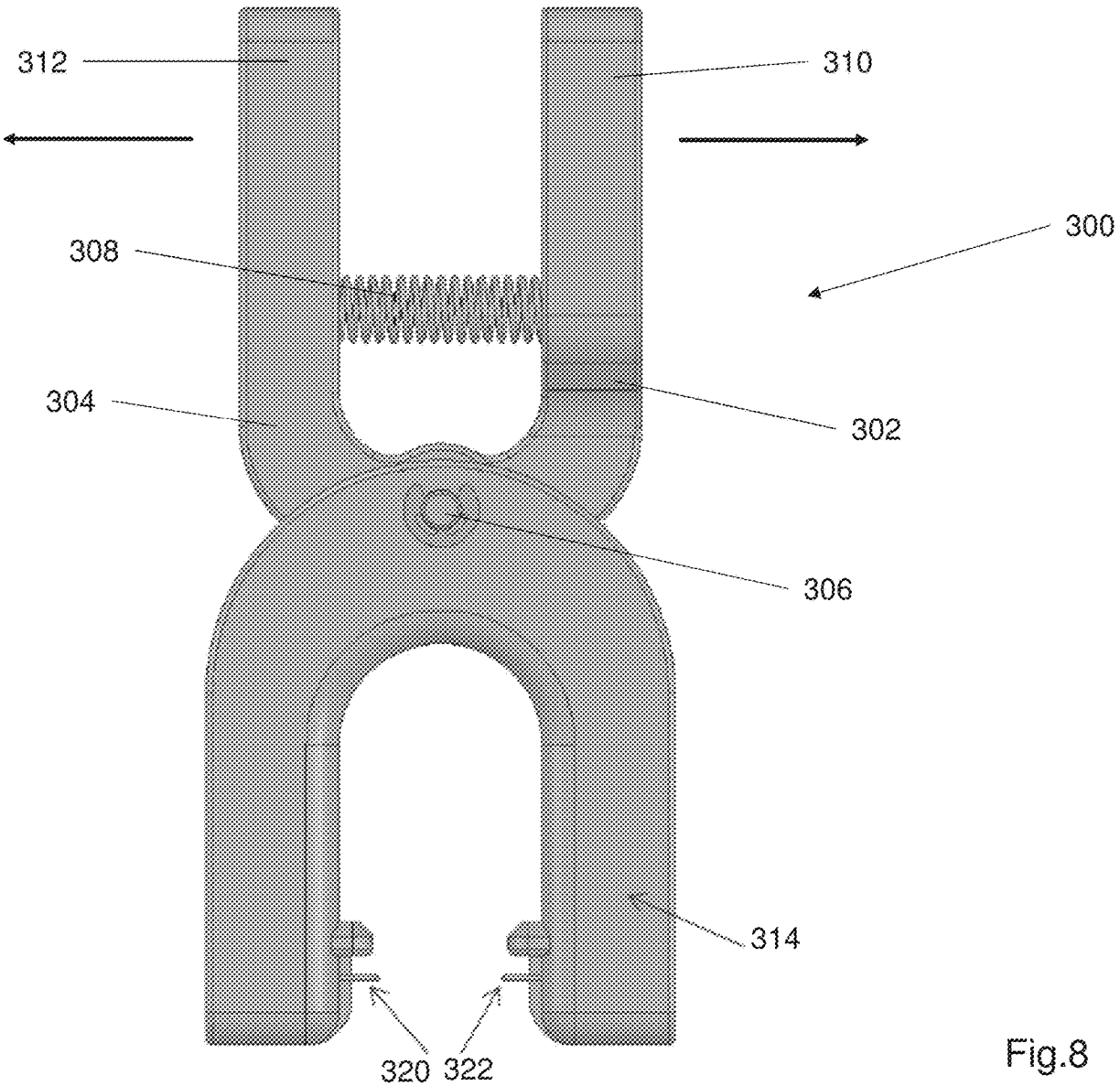
FIG. 8 illustrates the unlocking tool.
Figure 9:
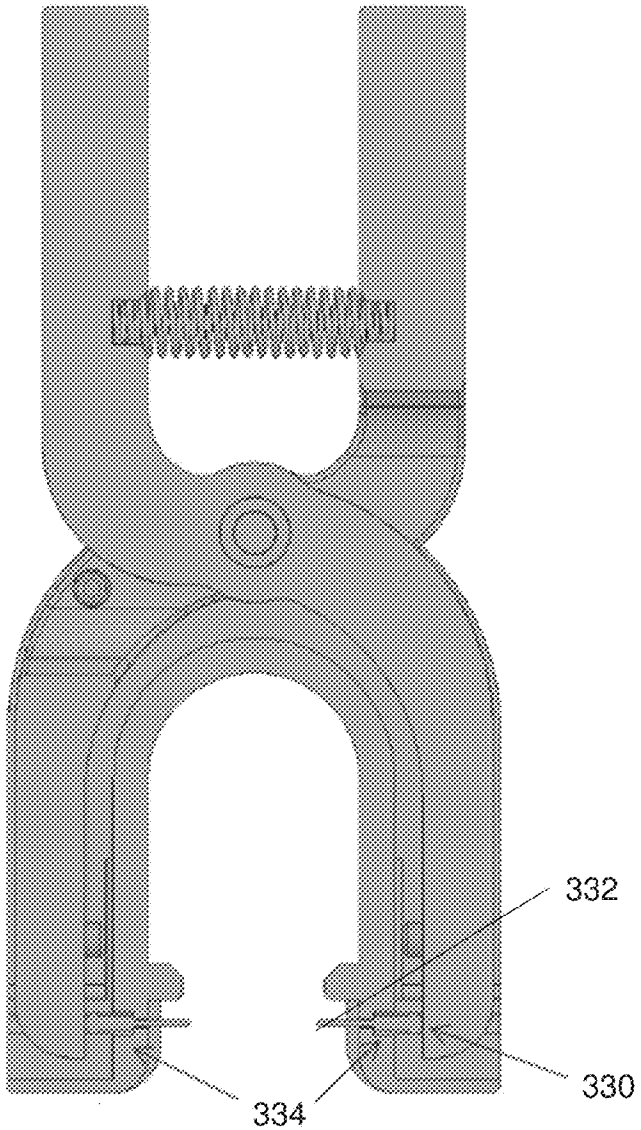
FIG. 9 illustrates a cross section of the unlocking tool.
Figure 10:
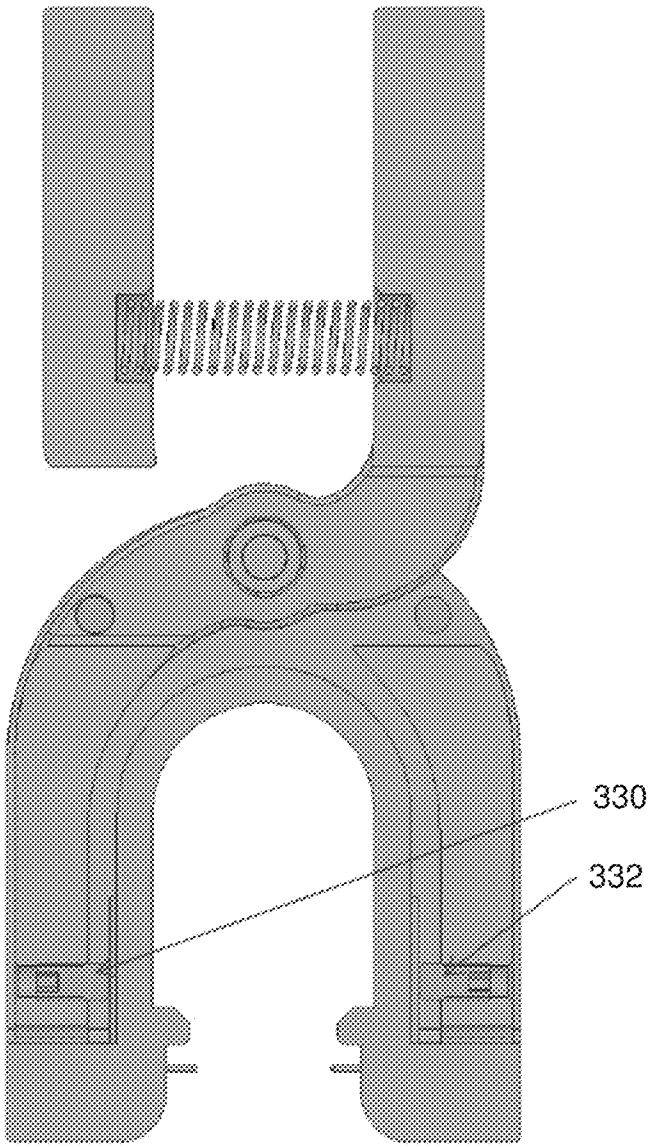
FIG. 10 illustrates internal details of the unlocking tool.

The lock 200 can only be unlocked by a specifically designed unlocking tool. The unlocking tool is used with the security strap device 10 to unlock it. FIGS. 8 to 10 illustrate an example embodiment of an unlocking tool 300. FIG. 1 shows the unlocking tool 300 placed in an operative position. The unlocking tool 300 is placed about the lock 200. The unlocking tool 300 is actuated to unlock the lock 200 and allow removal of the strap. The unlocking tool 300 should be used by an authorised person.

Referring to FIGS. 8 to 10, the unlocking tool comprises a first arm 302 and a second arm 304. The first arm 302 and second arm 304 are coupled together by a pivot 306. The pivot 306 is a joint. The pivot 306 in the illustrated embodiment is a pin. However, the pivot may comprise a screw, multiple pins or any other suitable joint. The first arm 302 and second arm 304 can move relative to each other about the pivot 306 (i.e. joint). The unlocking tool 300 comprises a first handle 310 defined at one end of the first arm 302. The unlocking tool 300 comprises a second handle 312 defined at one end of the second arm 304. The first arm 302 and second arm 304 are curved.

The unlocking tool 300 comprises a spring 308. The spring 308 is a linear spring that biases the handles to a rest position when the handles are moved apart from each other. The spring 308 may be some other biasing member that is configured to bias the handles 310, 312 to a rest position. The spring 308 helps to provide a consistent and symmetrical force when a user moves the handles apart.

The unlocking tool comprises a lower housing 314. The lower housing 314 is a U shaped housing. The housing 314 is arranged to be in an upside down U orientation. The housing 314 comprises a plurality of unlocking features 320-323. The lower housing 314 preferably four unlocking features 320-323. The unlocking features are preferably pins 320-323. The pins 320-323 are moveable out of the housing 314 to bear against the latches 220-223 to unlock the lock 200. The arms 302, 304 and pivot 306 function like a plier mechanism that provides a symmetrical force onto the pins 320-323 to ensure the pins extend out of the housing 314 evenly and at the same rate.

FIG. 9 shows a cross section of the unlocking tool 300 and the internal view of the housing 314. Each arm 302, 304 comprises an actuation end 340, 342 respectively. The actuation ends of the arm are positioned in the housing 314. The unlocking features 320-323 comprise pins. Each pin comprises a cam surface 330 and a point 332. The pins 320-323 are identical to each other in size and shape. Each arm comprises a guide passage 334 formed at the end of the where the pins are located. Preferably each arm comprises two pins and each arm comprises a guide passage 334 for each pin to move through. The guide passage ensures the pin moves outward from the housing 314 in a linear direction. The guide passage is a narrow aperture with a cylindrical passage that is dimensioned to guide the movement of the pin in a linear fashion. Preferably the guide passage 334 for each pin is shaped and dimensioned to ensure each pin moves in a perfectly straight orientation and the pins all move parallel to each other. The pins are also simultaneously moved outward due to an actuation end of each arm 340, 342 acting on the cam surface 330 of each pin. The cam surface 330 causes any rotational movement from actuation end of each arm to be translated into a linear movement of each pin 320-323. The actuation ends 340, 342 (i.e. free ends of the arms) push the pins 320-323 out of the housing 314.

FIG. 10 shows illustrate further details of the housing 314. The housing comprises a pair of screws 350, 352. The screws adjust and control the limit each pin extends. The housing 314 may comprise four screws i.e. a screw for each pin. The screw can be adjusted by a screw driver or a separate customised tool.

The unlocking tool 300 is used to unlock the lock and allow the strap 100 to be removed. The unlocking tool 300 is used by a user pulling the handles 310, 312 apart as per the arrows shown in FIG. 8. The handles 310, 312 being pulled apart causes actuation ends 340, 342 to move toward each other within the housing 314. This causes the pins 320-323 to be pushed out simultaneously, at the same rate and the same distance as each other. The pins 320-326 extend through the pin holes 270-273 to push the latches 220-223 out of the locking slots 250, 252 to an unlocking position, simultaneously at the same rate. This unlocks the lock 200.

In an alternative embodiment each arm 302, 304 comprises an unlocking feature formed at the end of the arm opposite the handle. The handles 302, 304 are moved apart from each other, thereby causing the unlocking feature at the end of each arm to push the latches simultaneously from a locking position to an unlocking position. In one configuration each arm comprises two unlocking features located at the end opposite to the handle. The unlocking feature may be a pin. In this alternative configuration each arm comprises a pair of pins located at the end of the arm opposing the handles. Each of the two pins at the end of each arm are spaced from each other. The pins are spaced apart to align with the latches when the unlocking tool is positioned on the lock. The four pins i.e. two pins at the end of each arm are dimensioned and positioned such that when the unlocking tool is placed about the lock, moving the handles away from each other causes the pins to push on the latches to move the latches to an unlocking position to unlock the lock 200.

The security strap device 10 disclosed herein is advantageous because the lock cannot be easily tampered or unlocked. The lock 200 comprises a locking mechanism that comprises a locking mechanism that includes four latches (or more) that are biased by biasing members. The biasing members simultaneously bias the latches 220-223 to a locked position. A biasing member simultaneously acts on two latches simultaneously and floats between the two latches. This makes for a self locking mechanism i.e. if one latch is pushed the opposite latch is pushed to further lock the lock. The locking mechanism comprises four independent latches that are simultaneously biased to a locking position making the lock 200 difficult to pick or remove. The unlocking tool 300 allows an authorised user to unlock the lock by simultaneously moving the latches to an unlocked position.

The security strap device 10 as described herein can be used to mount a monitoring bracelet on a criminal such that the criminal can be monitored in a home detention situation. Alternatively, the security device may be used on baggage or other items that need to be secured. As a further alternative the security device 10 may be used on a secure witness e.g. a key court witness to securely monitor the witness. The security device 10 may be used on any other item or person where security is necessary.

The foregoing describes some example embodiment (or embodiments) of the present invention and modifications, obvious to those skilled in the art, can be made thereto without departing from the scope of the present invention. While the invention has been described with reference to the example embodiments it should be appreciated that the invention can be embodied in many other forms.

Reference to any prior art in this specification is not, and should not be taken as, an acknowledgement or any form of suggestion that the prior art forms part of the common general knowledge in the field of endeavour in any country in the world.

Although the present disclosure has been described in terms of certain embodiments, other embodiments apparent to those of ordinary skill in the art also are within the scope of this disclosure. Thus, various changes and modifications may be made without departing from the spirit and scope of the disclosure. For instance, various components may be repositioned as desired. Features from any of the described embodiments may be combined with each other and/or an apparatus may comprise one, more, or all of the features of the above described embodiments. Moreover, not all of the features, aspects and advantages are necessarily required to practice the present disclosure. Accordingly, the scope of the present disclosure is intended to be defined only by the claims that follow.

The various configurations or embodiments described are exemplary configurations only. Any one or more features from any of the configurations may be used in combination with any one or more features from any of the other configurations.

The invention claimed is:

1. A security strap device comprising:

a strap;

a lock, the lock comprising a locking mechanism;

a fixed portion of the strap being secured inside the lock;

a free end of the strap insertable into the lock to form a loop in the strap, the lock is configured to lock a portion of the strap to form the loop in the strap, wherein;

the locking mechanism comprises a plurality of latches moveable between a locking position and an unlocking position;

the plurality of latches engaging one or more locking slots within the lock when in the locking position to lock the strap within the lock;

wherein the latches are all simultaneously biased toward the locked position and the latches are required to be simultaneously displaced to an unlocking position to unlock the strap, and wherein the locking mechanism comprises a plurality of biasing members positioned within the lock, the plurality of biasing members associated with the plurality of latches and wherein the biasing members bias the latches toward the locking position.

2. A security strap device accordance with claim 1, wherein the lock comprises a first clamping member and a second clamping member, and the first clamping member is attached to the second clamping member by a hinge that allows the first clamping member to pivot between a closed position and an open position relative to the second clamping member.

3. A security strap device in accordance with claim 2, wherein the closed position the first clamping member is located adjacent the second clamping member, the first clamping member and second clamping member clamping a portion of the strap, and the first clamping member being spaced away from the second clamping member when in the unlocked position such that the strap is freely moveable within the lock.

4. A security strap device in accordance with claim 2, wherein the second clamping member includes the one or more locking slots, the plurality of latches engage the one or more locking slots when the first clamping member is moved to a closed position, and the strap is locked due to the first clamping member and second clamping member clamping the portion of the strap inserted into the lock.

5. A security strap device in accordance with claim 4, wherein each locking slot is formed on an inner surface of the respective side wall of the second clamping member.

6. A security strap device in accordance with claim 2, wherein the second clamping member comprises:

a base, a first wall and a second wall, the first and second walls upstanding from the base, the walls being spaced apart from each other and parallel to each other, wherein the base and the upstanding walls define a receptacle, a portion of the strap being fixed within the receptacle, and a first locking slot formed in the first wall and a second locking slot formed within the second wall, wherein the first locking slot and second locking slot are parallel to each other.

7. A security strap device in accordance with claim 2, wherein the strap comprises:

a plurality of fixing teeth comprising a plurality of upper teeth located at and/or adjacent the fixed portion of the strap;

a plurality of locking teeth comprising a plurality of upper teeth and lower teeth at and/or adjacent the free end of the strap;

wherein the fixing teeth are spaced away from the locking teeth along the length of the strap.

8. A security strap device in accordance with claim 7, wherein the first clamping member includes a plurality of base plate locking teeth extending from a base plate of the first clamping member, wherein the base plate locking teeth engage the upper teeth of the plurality of locking teeth of the strap when the first clamping member is in the closed position.

9. A security strap device in accordance with claim 7, wherein the lower teeth of the locking teeth engage the upper teeth of the fixing teeth when the free end of the strap is inserted into the lock to form a loop in the strap.

10. A security strap device in accordance with claim 9, wherein at least six upper teeth of the fixing teeth engage with at least six lower teeth of the locking teeth to lock the strap and form a loop in the strap.

11. A security strap device in accordance with claim 10, wherein the first clamping member comprises at least six teeth that engage at least six upper teeth of the locking teeth when the first clamping member is positioned in the closed position.

12. A security strap device in accordance with claim 2, wherein the fixed portion of the strap comprises a pair of attachment protrusions extending from a lower face of the fixed portion of the strap, the second clamping member comprises a pair of channels or apertures within the second clamping member, and the fixed portion of the strap is affixed in the second clamping member by fixing the pair of protrusions within the pair of channels or apertures.

13. A security strap device in accordance with claim 2, wherein the second clamping member comprises a plurality of pin holes, and each pin hole is aligned with the locking slot.

14. A security strap device in accordance with claim 13, wherein each of the pin holes aligns with a latch such that an unlocking tool can be used to push the latches via the pin holes to an unlocked position to unlock the lock.

15. A security strap device in accordance with claim 14, wherein the unlocking tool comprises:

a first arm and a second arm, a handle defined at one end of each arm, an unlocking feature located at or adjacent an end of the arm opposite to the handle, and a pivot coupling the first arm to the second arm, wherein, when the handles are moved apart from each other, the first and second arm move about the pivot, thereby causing the unlocking feature at the end of each arm to push the latches simultaneously from a locked position to an unlocked position.

16. A security strap device in accordance with claim 15, wherein each arm comprises two unlocking features located at the end opposite to the handle.

17. A security strap device in accordance with claim 15, wherein the unlocking feature is a pin, each arm comprises two pins that are spaced from each other, the pins are spaced apart to align with the latches when the unlocking tool is positioned on the lock.

18. A security strap device in accordance with claim 15, wherein the unlocking tool comprises a lower housing, the lower housing including a plurality of unlocking features and in use, the handles moving away from each other cause the end of the first arm and the end of the second arm to move toward each other and push the unlocking features toward each other.

19. A security strap device in accordance with claim 18, wherein the lower housing is a U shaped housing, the housing comprises a pair of free ends, the housing accommodating two pins at each free end, a first arm positioned inside one free end of the housing and the second arm position in the opposing end of the housing, the arms moveable within the housing to push on a cam surface of the pins to simultaneously push the pins toward each other.

20. A security strap device in accordance with claim 18, wherein, in use, the handles are moved away from each other causing the ends of the arms inside the housing to move in toward each other to simultaneously push the pins toward each other out of the housing, the pins being pushed out of the housing cause the latches to be pushed to an unlocked position.

21. A security strap device in accordance with claim 1, wherein the biasing member is positioned within the passage such that the biasing member can act on the body to bias each latch to a locking position.

22. A security strap device in accordance with claim 21, wherein the lock comprises four latches, two biasing members, each of the latches and biasing members located within the first clamping member, two latches extending out from a side wall of the first clamping member and two other latches extending from an opposing side wall of the first clamping member.

23. A security strap device in accordance with claim 1, wherein the four latches are arranged in pairs, each pair of latches is arranged such that the latches extend to a locked position in opposing directions, and each biasing member is positioned to act on each pair of latches and bias them away from each other.

24. A security strap device comprising:

a strap;

a lock, the lock comprising a locking mechanism;

a fixed portion of the strap being secured inside the lock;

a free end of the strap insertable into the lock to form a loop in the strap, the lock is configured to lock a portion of the strap to form the loop in the strap, wherein;

the locking mechanism comprises a plurality of latches moveable between a locking position and an unlocking position;

the plurality of latches engaging one or more locking slots within the lock when in the locking position to the lock the strap within the lock;

wherein the latches are all simultaneously biased toward the locked position and the latches are required to be simultaneously displaced to an unlocking position to unlock the strap, and wherein the locking mechanism comprises four latches and two biasing members, each biasing member associated with two latches and each biasing member biasing two latches simultaneously to a locking position.

25. A security strap device comprising:

a strap;

a lock, the lock comprising a locking mechanism;

a fixed portion of the strap being secured inside the lock;

a free end of the strap insertable into the lock to form a loop in the strap, the lock is configured to lock a portion of the strap to form the loop in the strap, wherein;

the locking mechanism comprises a plurality of latches moveable between a locking position and an unlocking position;

the plurality of latches engaging one or more locking slots within the lock when in the locking position to lock the strap within the lock;

wherein the latches are all simultaneously biased toward the locked position and the latches are required to be simultaneously displaced to an unlocking position to unlock the strap, and wherein each latch comprises a body, a locking tab extending from the body, and a pair of legs extending from the body in an opposing direction to the locking tab, wherein the pair of legs are spaced from each other and define a passage.

26. A security device and an unlocking tool comprising:

a security device comprising:

a strap;

a lock, the lock comprising a locking mechanism;

a fixed portion of the strap being secured inside the lock;

a free end of the strap insertable into the lock to form a loop in the strap, the lock is configured to lock a portion of the strap to form the loop in the strap, wherein;

the locking mechanism comprises a plurality of latches moveable between a locking position and an unlocking position;

the plurality of latches engaging one or more locking slots within the lock when in the locking position to the lock the strap within the lock; and wherein the latches are all simultaneously biased toward the locked position and the latches are required to be simultaneously displaced to an unlocking position to unlock the strap, the unlocking tool comprising:

a first arm and a second arm, a handle defined at one end of each arm, a plurality of unlocking pins located at or adjacent an end of the arm opposite to the handle, and a pivot coupling the first arm to the second arm such that the first arm can pivot relative to the second arm when the handles are moved, wherein, in use, the unlock tool is positioned such that one unlocking pin aligns with each latch, the handles being moved in a first direction to pivot the first arm relative to the second arm, thereby causing each unlocking pin to push the latches simultaneously from a locked position to an unlocked position thereby unlocking the lock to allow the strap to move.

* * * * *